United States Patent [19]

Garbini

[11] 4,265,045

[45] May 5, 1981

[54] RIFLE AND WEAPON REST

[76] Inventor: Louis K. Garbini, Schöntal, CH-9304 Bernhardzell, Switzerland

[21] Appl. No.: 526

[22] Filed: Jan. 2, 1979

[30] Foreign Application Priority Data

Jan. 11, 1978 [CH] Switzerland ..... 257/78
Oct. 20, 1978 [CH] Switzerland ..... 10855/78

[51] Int. Cl.[3] ..... F41C 29/00
[52] U.S. Cl. ..... 42/94
[58] Field of Search ..... 42/94; 89/37 B, 37 BA

[56] References Cited

U.S. PATENT DOCUMENTS

| | | | |
|---|---|---|---|
| 2,870,683 | 1/1959 | Wilson | 42/94 |
| 3,016,802 | 1/1962 | Grunenberg | 42/94 |
| 3,225,656 | 12/1965 | Flaherty et al. | 42/94 |
| 3,703,046 | 11/1972 | Barone et al. | 42/94 |

*Primary Examiner*—Charles T. Jordan
*Attorney, Agent, or Firm*—William R. Price

[57] ABSTRACT

The invention is shown as a rifle and weapon rest for supporting the weapon during aiming and firing. There is an upper, partially limited, radially movable rifle holder having a fixed or an adjustable weapon holding strap and a pressure rod spring-supported vertically and axially, which is received displaceably in a guide tube. The guide tube is supported from a holding body by an adjustable rack-and-pinion mechanism. The holding body is supported from the ground by two collapsible strut members. Several modifications of means for detachably and pivotally connecting the rifle stock to the rifle holder are included.

13 Claims, 10 Drawing Figures

RIFLE AND WEAPON REST

BACKGROUND OF THE INVENTION

1. Field of the Invention

The invention relates to a rifle and weapon rest for supporting the weapon during aiming and firing.

2. Description of the Prior Art

Until now there have been used as rifle and weapon rest pads, boxes or other objects, or fixed supports, but these were difficult to handle, adjustment of the weapon being time-consuming, or allowing the marksman too little adaptability. Also, these objects are not foldable or collapsible and are not suitable for carrying in a small briefcase or pouch.

OBJECTS OF THE INVENTION

It is the object of the present invention to design a rifle and weapon rest so that it is easy for the marksman to adjust, that it can be collapsed and folded to minimum size, so that it can be carried in a briefcase or pouch.

A further object of the present invention is to design a rifle and weapon rest of the above mentioned kind so that aiming is greatly facilitated.

SUMMARY OF THE INVENTION

For the solution of the problem posed, the invention is characterized in that, by means of a pressure rod and spring, a rifle holder adapted for partial radial rotation is guided with spring support in a guide tube symmetrically in axial and vertical directions, and that the guide tube is axially and vertically adjustable continuously in a holding body taking support on the ground by means of struts.

It is important according to the present invention that it comprises an upper, partially limited, radially movable rifle holder having a fixed or an adjustable weapon holding strap and a pressure rod spring-supported vertically and axially, which is received displaceably and spring-supported in a guide tube. The guide tube in turn is received adjustably through a rack-and-pinion adjustment by a holding body, on which are fitted articulatedly and detachably two struts to be plugged in or screwed in.

The rifle and weapon rest of the invention has the important advantage that due to the spring-supported construction of the rifle holder, after a shot has been fired, when the rifle is pulled upward, the rifle holder follows the movement of the weapon, the struts remaining firmly on the ground, so that immediately thereafter a new aiming process can be initiated.

In a first embodiment of the present invention, the rifle is received in the rifle holder floatingly, as it were, with play, that is, a certain clearance exists between the rifle stock and the holding straps of the rifle holder, so that the weapon is only placed on, not clamped. Thereby the requirement is fulfilled that with the weapons type "firing on rest" the stock is only placed in the rifle holder.

In a second embodiment of the present invention, a fixed but detachable and articulated connection between the stock and the associated rifle holder is provided, resulting in further advantages.

With a fixed connection between the stock and the associated rifle holder it becomes possible to use a rifle for sharp-shooters on uneven terrain, at wall projections and on stairs, as well as on house roofs, because the rifle rest of the invention is continuously adaptable to unevennesses of the ground, the rifle holder remaining always horizontally and vertically aligned.

The construction of the adjustable and detachable attachment between the weapon and the associated rifle holder of the rifle rest can be effected in various ways. In a first form it is provided that there is attached on the underside of the weapon a plug-in tongue which is articulatedly and detachably secured in a receiving head secured to the rifle holder.

A second form of construction provides for the reversal of the first form, namely that the respective receiving head is secured on the underside of the weapon, and that the plug-in tongue, articulatedly and releasably secured in the receiving head, is connected with the rifle holder.

The releasable attachment of the plug-in tongue in the receiving head of the rifle holder can be obtained in that for example in the plug-in tongue a countersink or a fitting hole is provided, into which a spring-supported spherical pressure piece engages. Further, instead of the spherical pressure piece one can use a fitting bolt to be screwed in or plugged in which engages through a fitting hole.

In a further form of construction it is provided that the attachment between the weapon and the rifle holder is designed as a one-arm articulated hinge. This may be either a ball hinge or a flap hinge. To adapt the struts to various unevennesses of the ground, it is important that the struts are fastened to a holding body so as to be rotatable in a horizontal axis as well as variable in their length, the holding body being in turn adjustable in length and receiving the guide tube which receives the spring.

BRIEF DESCRIPTION OF THE DRAWINGS

The invention will now be explained in greater detail in reference to several embodiments. Further important advantages and features of the invention will then be evident from the drawings and their description.

FIG. 10 is a fragmentary view of a hinge type receiving head to be screwed on.

DESCRIPTION OF THE PREFERRED EMBODIMENTS

Figure 1:
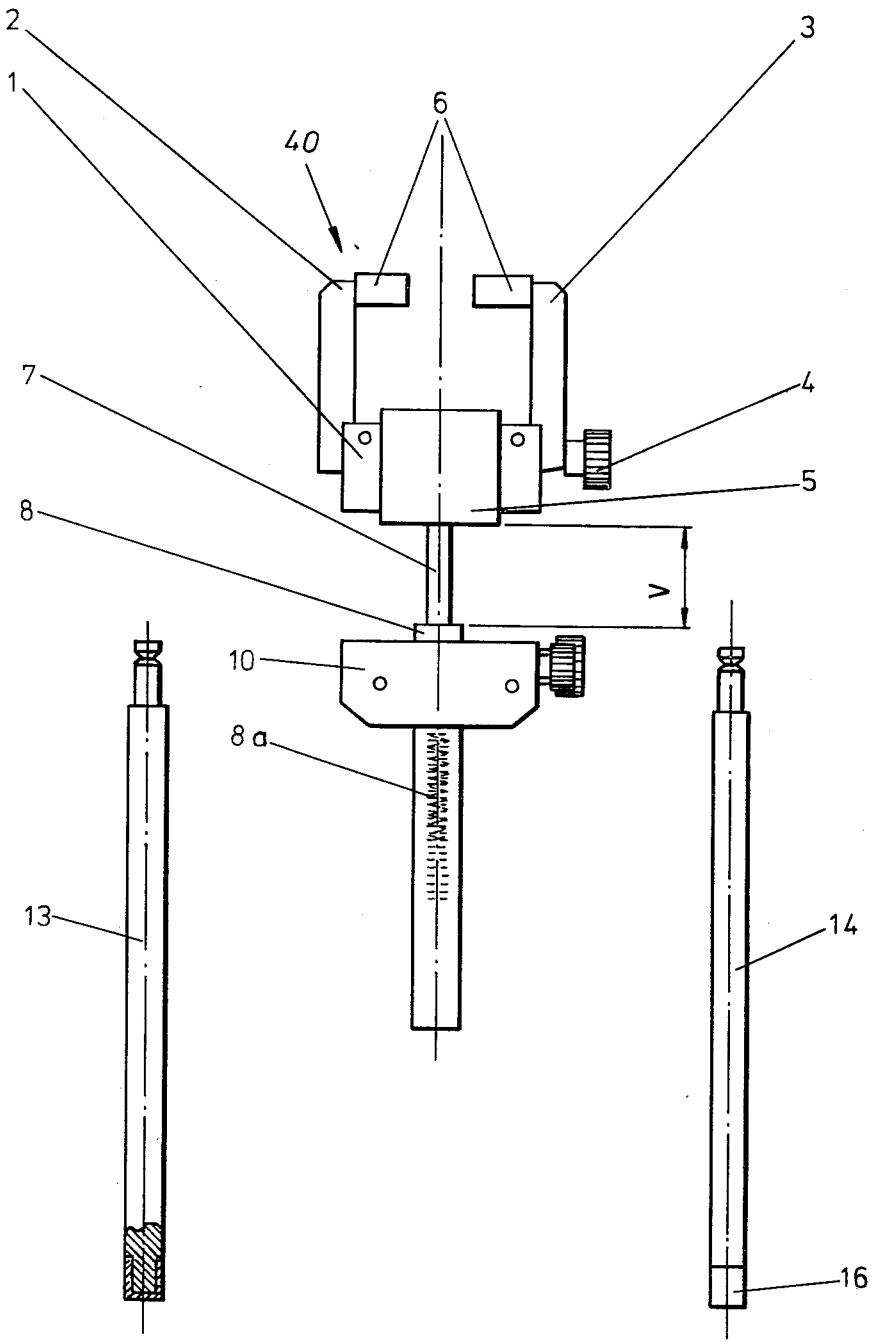
FIG. 1 shows an exploded view of a disassembled rifle rest, partly in section.
Figure 2:
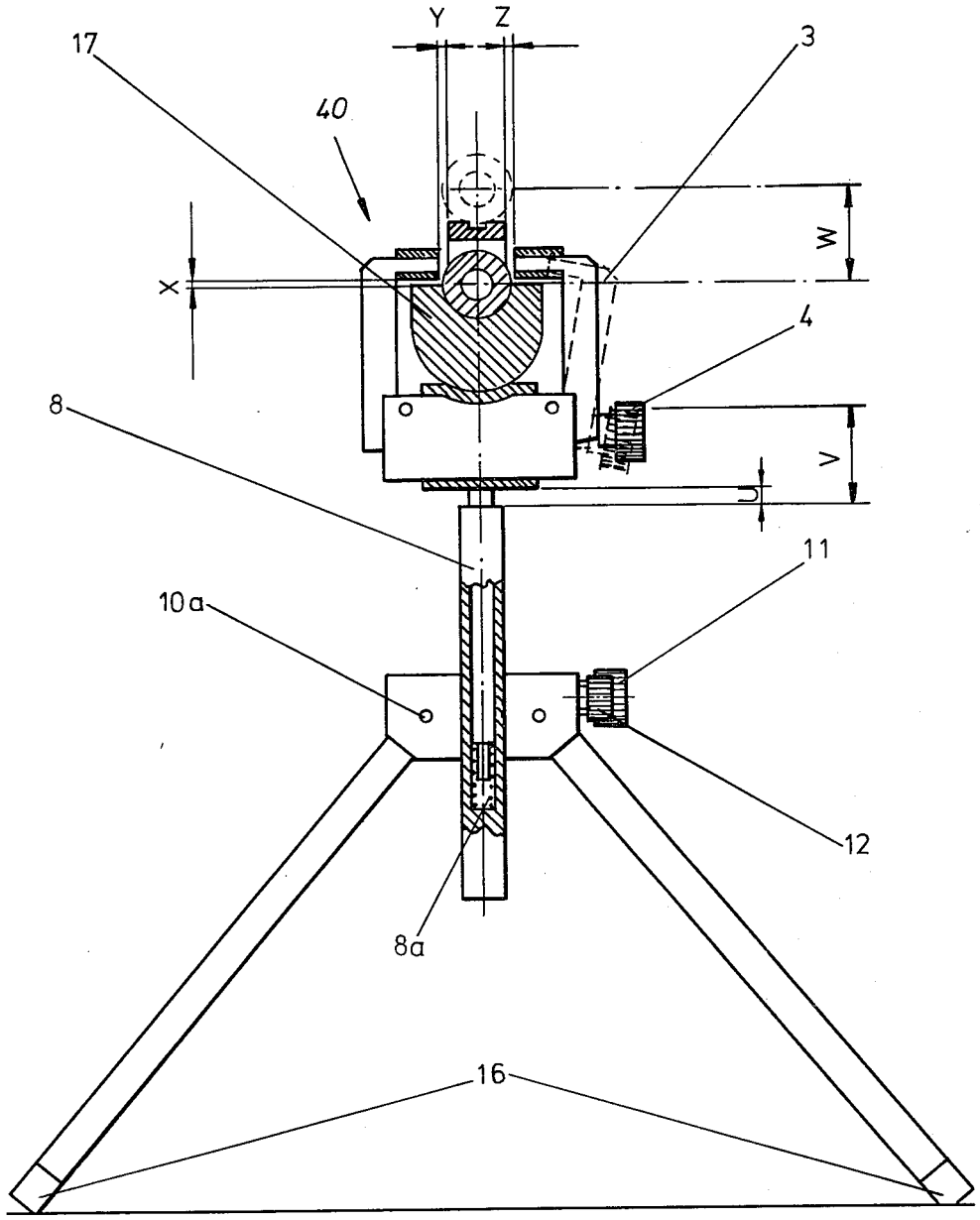
FIG. 2 is a front view of a rifle rest with the struts mounted, with the weapon placed on in firing position, partly in section.

According to FIG. 1, this novel rifle rest comprises an upper part, which serves as rifle holder 40. It consists of a seating 1, further of a fixed holding strap 2 and a holding strap 3 to be pivoted out and to be positioned crosswise to the rifle axis, in which strap a clamping screw 4 is screwed crosswise to the rifle axis, with which the holding strap 3 is positioned to the weapon 17 (FIG. 2). The seating 1 is provided with a damping and protective element 5, and also the two holding straps 2 and 3 are equipped for protection of the rifle against damage and with a damping material 6.

Figure 3:
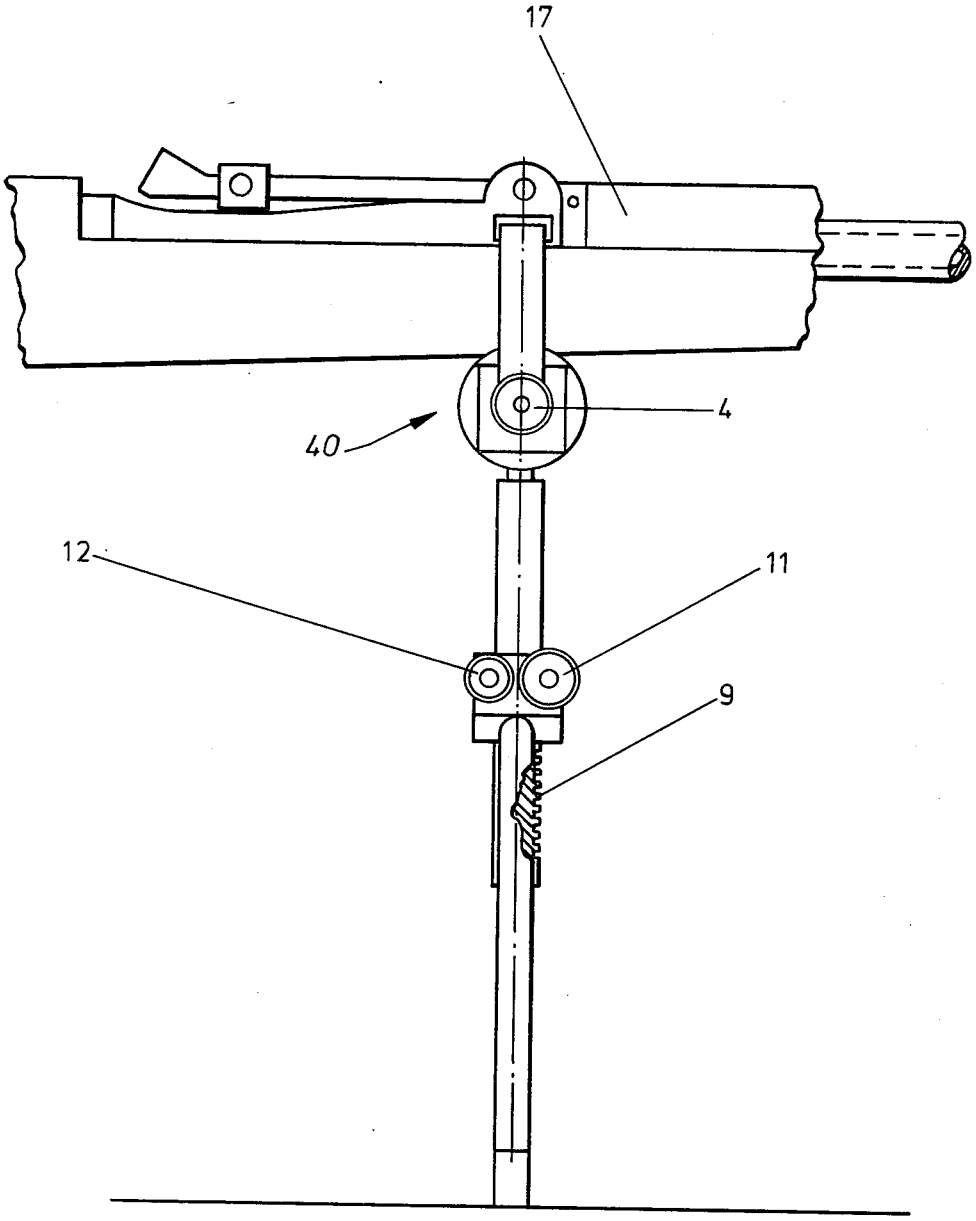
FIG. 3 is a right side view of the rifle rest with clamped weapon in firing position.
Figure 4:
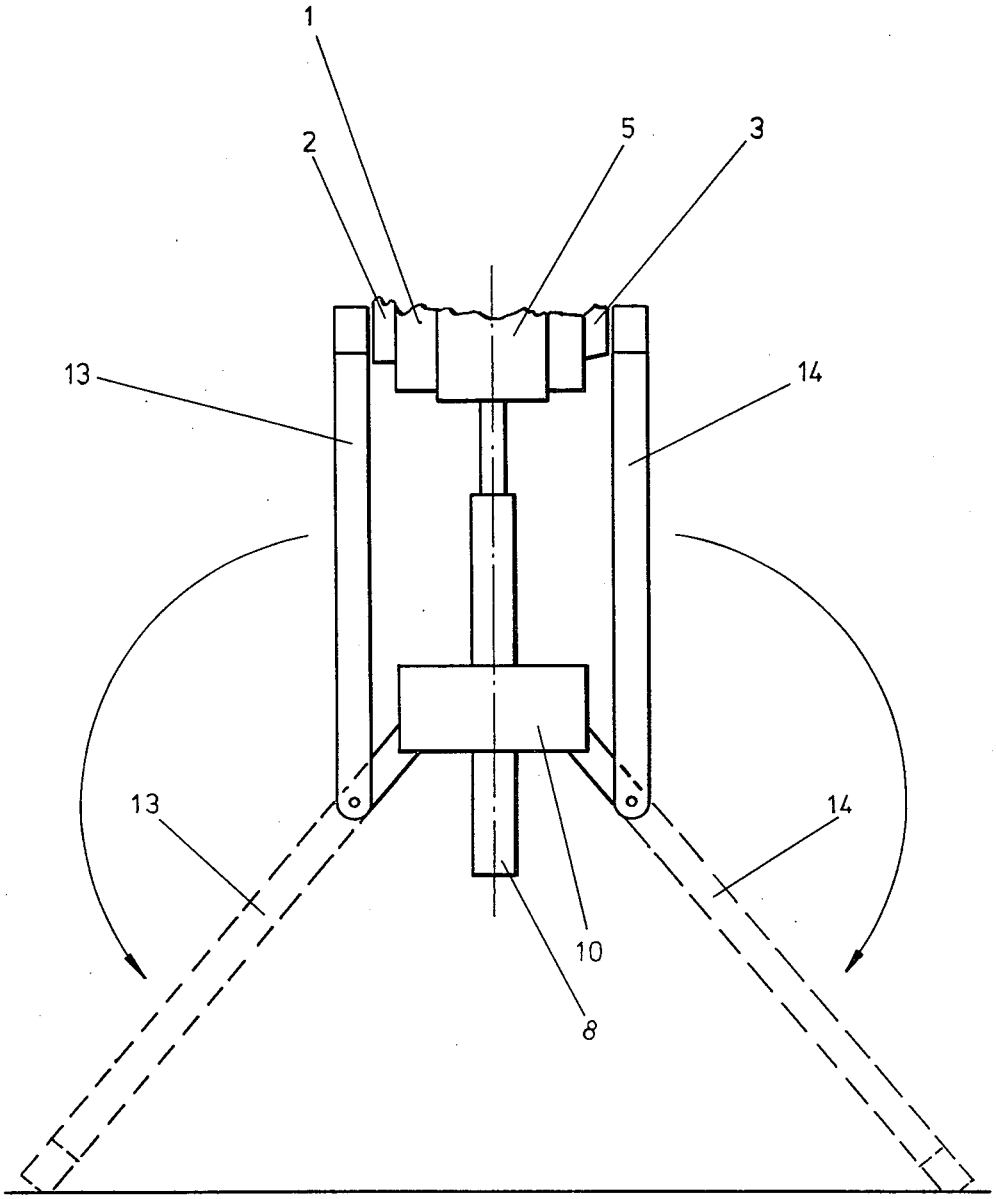
FIG. 4 is a view of a further embodiment with the struts folded up.

In seating 1 a vertical pressure rod 7 is secured, which in turn is inserted in a vertically and axially adjustable guide tube 8 in a spring-supported and displaceable manner. A spring 8*a* is mounted in guide tube 8. The outer periphery of guide tube 8 is provided with a toothed section or rack 9 (FIG. 3) and by means of a pinion 11 it is vertically and axially displaceable in a bore in a lower holding body 10. After completed adjustment, the guide tube 8 can be fixed on the holding body 10 by means of clamping bolts 12 (FIG. 3). On the sides of the holding body 10, two struts 13, 14 extending at an angle of about 40° are plugged in, screwed in or folded down crosswise to the rifle axis (FIG. 4). In the plugged-in construction, the struts 13, 14 are fixed in their longitudinal direction by a spring-supported ball mechanism 10*a* that snaps in (FIG. 2). At their ends resting on the ground, the struts 13, 14 are provided with damping elements 16 of rubber or plastic (FIG. 2).

When inserting the weapon in the rifle rest, seating 1 is pushed vertically downward by the additional weight (distance V-U), and pressure is applied on spring 8*a* in the guide tube 8.

The weapon inserted between the two holding straps 2 and 3 can now, after unlocking the clamping bolt 12, be brought to the desired height, the rifleman being in prone position, and can be adapted to the respective ground and shooting range conditions.

This novel rifle rest also offers the advantage over the conventional rifle supports that between the rifle stock and the holding straps 2 and 3 a clearance or play of about 1–2 mm (distance or dimension X,Y,Z) exists. The weapon is thus only placed on, not clamped, and takes the instruction and concept "firing on rest" fully into account.

With the firing of the shot the weapon is pulled up a certain distance (W). The seating 1 now follows the sudden upward movement of the weapon (17) over a certain distance (v) owing to the compressed and now relaxing compression spring 8*a*.

The struts 13, 14 now move slightly and adhere to the ground by the lower holding body 10.

The described rifle rest provides the older marksman, ladies and invalids, a tool which greatly improves their accuracy of aim.

It has above all the further advantages that this rest is very quickly mounted on the weapon, adjusted within seconds by means of the vertical setting device, and adapted to the marksman as well as to the ground and shooting range conditions. During aiming, the weapon is further capable of being adapted to the marksman owing to the elastic damping elements and partial radial mobility of the implement supperstructure, in any desired direction. It is also very quickly disassembled and permits the marksman rapid changeover to shooting without rest. Further the implement offers the advantages that, when disassembled, it fits into a small briefcase, being an extremely light-weight small device weighing less than 900 grams and having the dimensions 270 mm × 100 mm × 30 mm. Another important factor is that all parts except the screw and clamping elements are made of an aluminum alloy. A second construction, however, may provide alternatively that the parts consist of castings, forged or stamped parts of steel.

In the second form of construction according to FIGS. 5–10 it is essential that the rifle and weapon rest according to FIGS. 1–4 is developed in a manner that the rest can be used also by sharpshooters. There is then used an articulated attachment between the rifle stock and the rest, thereby avoiding a floating attachment according to the design of FIGS. 1–4.

Figure 5:
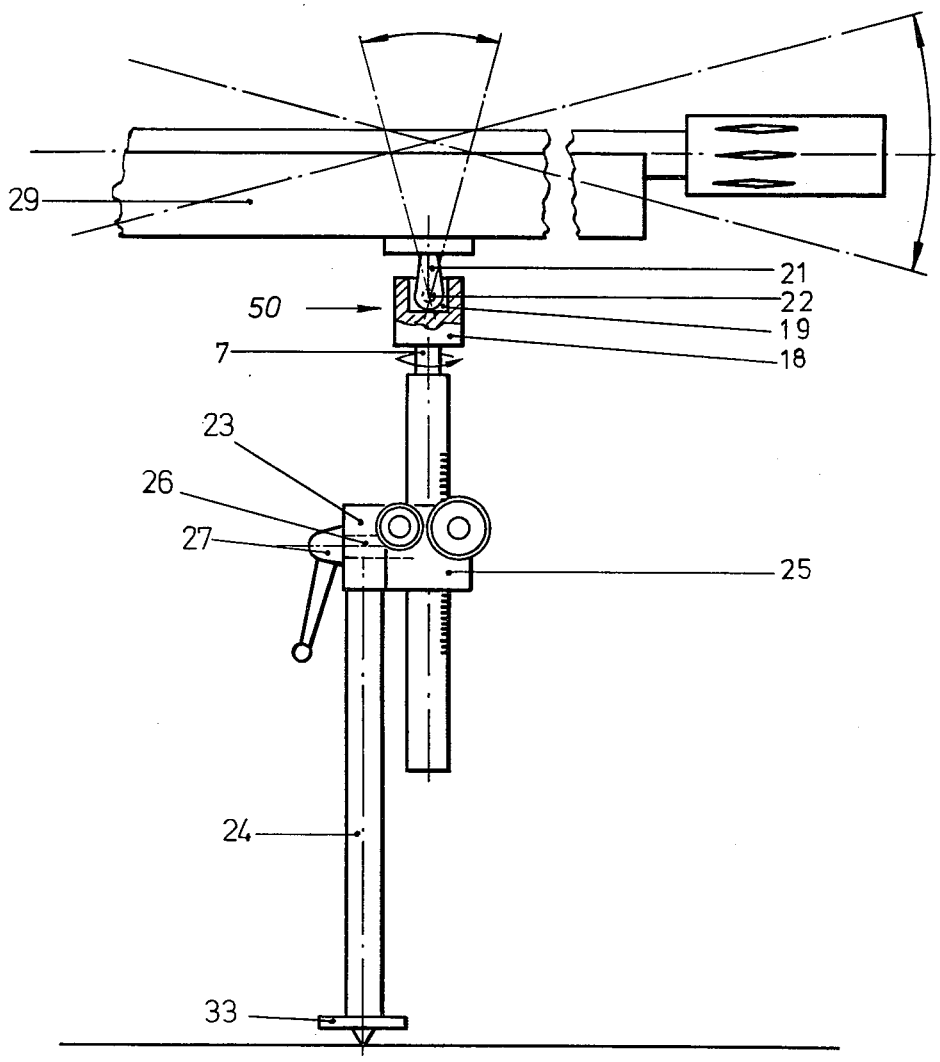
FIG. 5 is another modification of a rifle support (tripod) with inserted weapon in firing position, in side view, partly in section.
Figure 9:
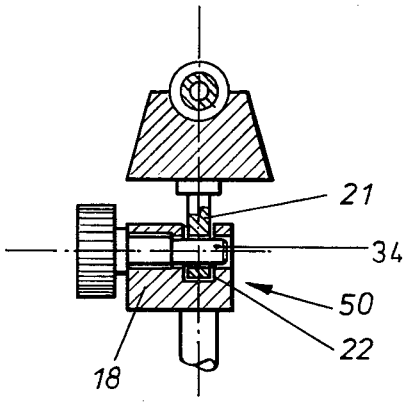
FIG. 9 is a fragmentary view of the receiving head (rifle holder) with pocket type recess and a fitting bolt to be screwed in or plugged in, in section.

According to FIG. 5, this novel rifle support comprises an upper part, which serves as rifle holder 50. It consists of a receiving head 18 with pocket type or pan type recess 19, and a spring-supported fixing element (spherical pressure piece 20) (FIG. 6), or of a bolt 34 to be screwed in or pushed in (FIG. 9). On the weapon, a ball-, or drop- pear-shaped plug-in tongue 21 having a countersink or fitting hole 22 to receive and lock the spherical pressure piece 20 or bolt 34 (FIG. 9) is provided. In addition, the plug-in tongue 21 has contact faces 28 (FIG. 6) laterally.

The above described plug-in principle has the advantage that the rifle support is securely mounted on the weapon within seconds. The pear-shaped form of the plug-in tongue 21 also has the advantage that in the longitudinal axis the rifle has great additional mobility for backward and forward inclination and enables the sharpshooter to shoot at moving targets while staying in a perfectly still position.

In the lower portion the rifle rest comprises a supporting element 23 with adjustable and exchangeable struts 24, which element is mounted on a holding body 25 crosswise to the rifle axis for continuous rotation on the shaft 26 and is fixed on the holding body 25 by means of a clamping lever or knurled nut 27.

Figure 6:
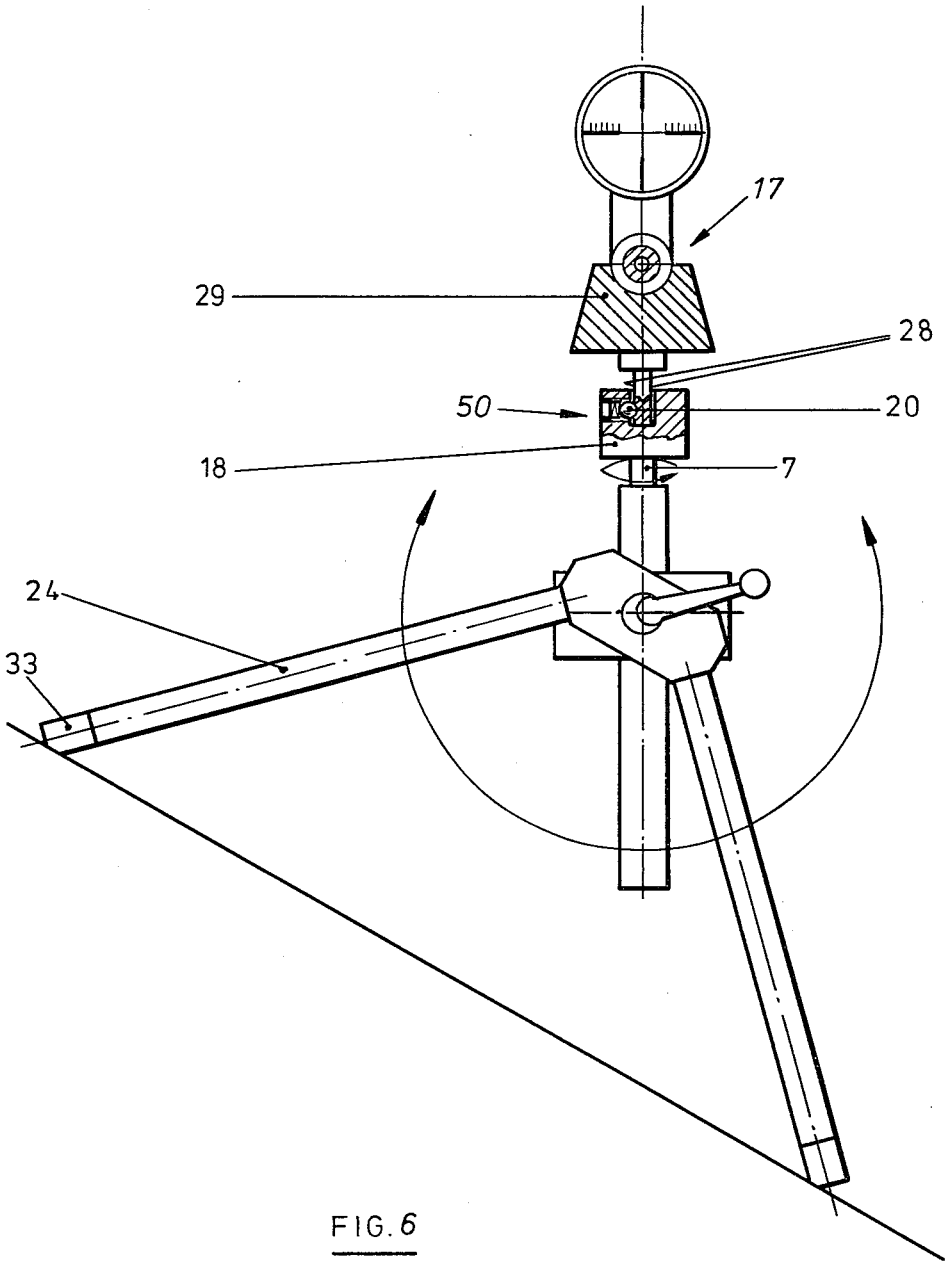
FIG. 6 is a rifle support with inserted weapon in firing position (viewed in the direction of the rifle axis)
Figure 7:
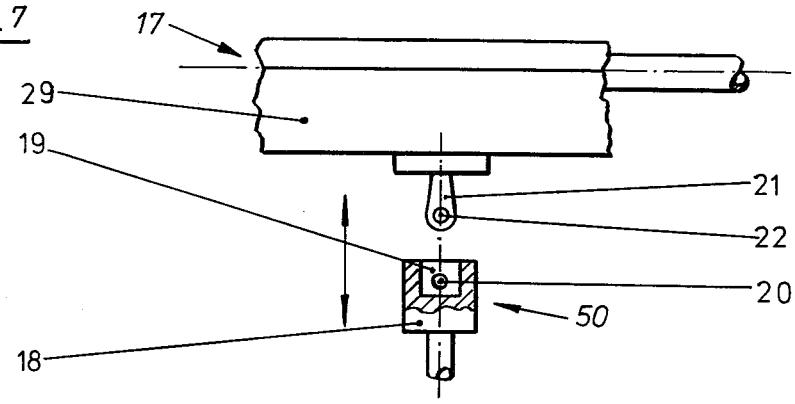
FIG. 7 is a fragmentary side view of the receiving head (rifle holder) with pocket type recess with the weapon disengaged, in section.

This additional device has the advantage that the weapon seating can be used in slanting, uneven terrain, on stairs, rocks, concrete, ruins, lawn, etc., the precision rifle with aiming telescope being thus positioned absolutely horizontally (FIG. 6). Depending on the nature of the terrain or the possibility of setting up the rifle support with the weapon, the rest elements 33 (steel disk with tip) (FIG. 5) or rubber feet (FIG. 6) are exchanged.

This further developed model of the rifle support offers the advantages that it can be mounted on any commercial weapon type, and it easily fits into the weapon case, being a small device of a weight of 65 grams and the dimensions 200 mm × 100 mm × 70 mm.

To limit the lateral inclination of the weapon, the plug-in tongue 21 is provided with lateral contact faces 28 which strike against corresponding faces of recess 19 of the rifle holder 50, 51.

Figure 8:
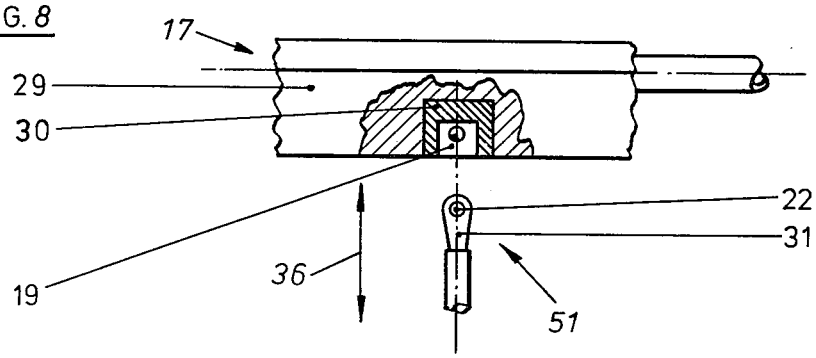
FIG. 8 is a view similar to FIG. 7 of another modification where the pocket type recess is provided on the underside of the rifle stock and the plug-in tongue is provided at the upper part of the rifle support.

FIG. 8 shows that, reversing the above described embodiments, the rifle holder 51 may be formed in that a seating 30 is provided in the underside 29 of the weapon 17, and that the pressure rod 7 of the rifle holder is connected with an associated plug-in tongue 31. It is then possible again in a simple manner to plug the weapon 17 onto the tongue 31 in the direction of arrow 36.

FIG. 9 shows that instead of a spherical pressure piece 20 shown in FIG. 6 a fitting bolt 34 plugged or screwed into the receiving head 18 can engage through the fitting hole 22 of the plug-in tongue 21.

Figure 10:
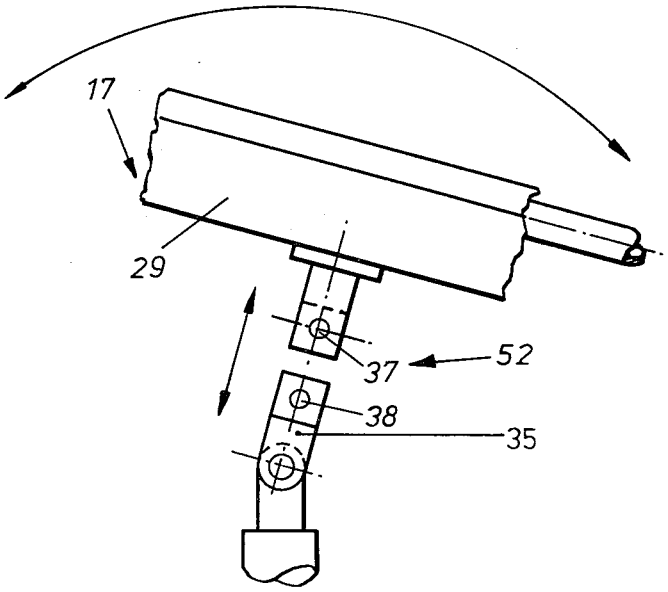

FIG. 10 shows a further form of construction of a rifle holder 52; here the connection between the pressure rod 7 and the weapon 17 consists of a hinge 35 screwed to the underside 29 of the weapon 17, which hinge may be designed either as a one-arm flap hinge or as an adjustable ball-and-socket joint. The connection is then effected in that the bores 37, 38 are brought into coincidence, whereupon a fitting bolt or other locking element engages through the bores 37, 38 and connects the two parts of the hinge 35 releasably.

I claim:

1. Rifle and weapon rest, for use with a rifle for support of said rifle during the process of aiming, which comprises: a pressure rod (7) and spring (8*a*), a rifle holder (40, 50, 51, 52), adapted for partial radial rotation; a spring support, and a guide tube (8) for guiding said rifle holder symmetrically in axial and vertical directions, said guide tube (8) being axially and vertically adjustable continuously; and a holding body having struts (13, 14, 24) which takes supports on the ground.

2. Rifle and weapon rest, according to claim 1, the further combination of a rack and pinion (9, 11) which allows adjustment between the guide tube (8) and the holding body (10, 25) .

3. Rifle and weapon rest, according to claim 1, the further combination therewith of lateral holding straps (2, 3) in operative relation with said rifle holder (40) and formed in such a way that in the firing position the rifle (17) has the limited leeway of about 0.5–2.5 mm (dimension X, Y, Z).

4. Rifle and weapon rest, according to claim 1 or 3, the further combination of hole or snap-in marks (9), located on the outer periphery of the guide tube (8).

5. Rifle and weapon rest according to claim 1, 2, 3 or 4, characterized in that the struts (13, 14) are mounted on the lower holding body (10, 25,) to be extended and collapsed crosswise to the rifle axis.

6. Rifle and weapon rest according to claim 1, the further combination of an adjustable and detachable attachment provided between the rifle (17, 29) and the rifle holder (50, 51, 52) (FIG. 5–10).

7. Rifle and weapon rest, according to claim 6, in which the attachment is in the form of a plugged-in tongue (21) fastened on the underside (29) of the rifle (17) in combination with a receiving head (18) fastened articulatedly and detachably to said tongue, said receiving head (18) being fastened on the rifle holder (50) (FIG. 5–7, 9 and 10).

8. Rifle and weapon rest, according to claim 6, the combination therewith of a seating (30) and plug-in tongue (31), said seating (30) fastened on the underside (29) of the rifle (17) cooperates with a plug-in tongue (31) connected with the receiving head of the rifle holder (51) and is articulatedly and detachably fastened thereto (FIG. 8) to form said attachment.

9. Rifle and weapon rest according to claim 7 or 8, characterized in that the plug-in tongue (21, 31) is pear-shaped or drop-shaped and has lateral contact surfaces (28) (FIG. 6).

10. Rifle and weapon rest, according to claim 7 or 8, in which the articulated attachment of the plug-in tongue (21, 31), on the receiving head (18) of the rifle holder (50, 51), formed by the plug-in tongue (21, 31) includes a counter sink or fitting hole (22) and a spring-supported, spherical pressure piece (20) engagable therewith (FIG. 6).

11. Rifle and weapon rest, according to claim 7 or 8, characterized in that the articulated attachment of the plug-in tongue (21) and the receiving head (18) of the rifle holder (50, 51) includes a fitting bolt (34) and a fitting hole (22) in the plug-in tongue, said fitting bolt being screwed or plugged into the receiving head (18) to engage through the fitting hole (22) in the plug-in tongue (21, 31).

12. Rifle and weapon rest according to claim 6, characterized in that the attachment between the rifle (17, 29) and the rifle holder (52) includes an articulated hinge (35) screwed to the rifle (17, 29) (FIG. 10).

13. Rifle and weapon rest, according to claim 1 the combination therewith of a supporting element, a clamping lever and a knurled nut (27), said supporting element having struts (24) mounted in an axis (26) crosswise to the longitudinal axis of the rifle, said supporting element (23) being fastened to the holding body (25) so as to be rotable and fixable by said clamping lever and said knurled nut (27) (FIG. 5, 6).

* * * * *